US006055902A

United States Patent [19]

Harrop et al.

[11] Patent Number: 6,055,902

[45] Date of Patent: May 2, 2000

[54] COMPACTION APPARATUS WITH ELECTRICAL RAM MOTION CONTROL RESPONSIVE TO MOTOR CURRENT

[75] Inventors: Shannon Harrop, Springdale; James Davis, Siloam Springs, both of Ark.

[73] Assignee: J. V. Manufacturing, Inc., Springdale, Ark.

[21] Appl. No.: 09/218,348

[22] Filed: Dec. 22, 1998

[51] Int. Cl.[7] ..... B30B 15/16

[52] U.S. Cl. ..... 100/52; 100/51; 100/99; 100/50; 100/229 A

[58] Field of Search ..... 100/229 A, 48, 100/99, 50, 51, 52; 361/93.9, 94, 95, 96, 97

[56] References Cited

U.S. PATENT DOCUMENTS

| | | | |
|---|---|---|---|
| 3,608,476 | 9/1971 | Price et al. | 100/50 |
| 4,232,599 | 11/1980 | Ulrich | 100/53 |
| 4,643,087 | 2/1987 | Fenner et al. | 100/229 A |
| 4,953,109 | 8/1990 | Burgis | 100/50 |
| 5,558,013 | 9/1996 | Blackstone, Jr. | 100/50 |
| 5,751,532 | 5/1998 | Kanuchok et al. | 361/94 |
| 5,773,945 | 6/1998 | Kim et al. | 361/94 |

OTHER PUBLICATIONS

ECS Series AC Current Sensor. Datasheet [online]. SSAC Inc., 1996 [Retrieved on Jul. 27, 1999]. Retrieved from the Internet:<URL:www.ssac.com/cgi–bin/compile html.pl/wall/data/sect–h/ecs/ecsdata.html.

*Primary Examiner*—Peter Vo
*Assistant Examiner*—Louis K. Huynh
*Attorney, Agent, or Firm*—Head, Johnson & Kachigian; Robert R. Keegan

[57] ABSTRACT

There is disclosed compaction apparatus for waste management and recycling purposes including a hydraulic cylinder driven ram capable of exerting very large forces to compact waste paper, trash, or similar commercial or residential waste material. The hydraulic system of the apparatus includes a pump powered by a large electric motor. Forward and reverse motion of the ram is controlled by solenoid valves controlled by limit switches or position sensing switches responding to ram position, and in some cases to time delay devices coordinated with the travel time of the ram. Means for sensing a high resistive force encountered by the ram indicates that a waste container is full or nearly full or in certain apparatus may indicate a need to reverse a baler ram to a rest position to receive more waste material. A motor current sensor is used for indirectly determining when the resistive force on the ram reaches a set value and includes a current level adjustment and an adjustable delay setting so that no responsive action occurs in the apparatus for high currents lasting less than 1 second or other preset time value. Accordingly, high currents on motor starting and also momentary high currents in trash compaction do not give false signals indicating fullness of a container or other false indication. The control logic is simple and is executed by relays which may be electromechanical or solid-state.

18 Claims, 7 Drawing Sheets

COMPACTION APPARATUS WITH ELECTRICAL RAM MOTION CONTROL RESPONSIVE TO MOTOR CURRENT

CROSS REFERENCE TO RELATED APPLICATION

None.

TECHNICAL FIELD

The present invention relates to compaction apparatus, particularly waste paper balers and industrial trash compactors in particular, such trash compaction devices which include a sensor as an indicator for the fullness of a trash compactor that is responsive to the resistive force encountered by the ram of the trash compactor. Similarly, waste paper balers have sensors which respond to the resistive force on the baler ram or platen in order that it will retract and prepare the apparatus for the next compaction cycle.

BACKGROUND OF THE INVENTION

The present invention relates to compaction equipment for commercial and industrial trash compaction to facilitate refuse disposal and to waste paper baler equipment utilized in paper recycling, both of which are important and widely used tools in the field of waste management. It is very desirable that this equipment be both efficient and reliable. As with all powerful mechanical equipment, safety hazards should be eliminated to the maximum extent possible, recognizing that there is a tendency for human operators to be less careful than they should be.

Although the invention with which this application is concerned is useful in both waste paper balers and in trash compactors, this background discussion will primarily concern itself with trash compactors, since they are possibly the more widely used and common form of equipment. The detailed description below will also fully describe balers incorporating the invention. The commercial or industrial trash compactor which will be referred to herein simply as "trash compactor" is found in many situations where there are large volumes of waste to be disposed of in landfills or other waste disposal facilities. Thus, trash compactors are found in shopping centers, industrial complexes, associated with large discount stores or department stores, and in some residential complexes.

The use of trash compactors has obvious advantages over the common dumpster, the capacity of which is limited to the amount of uncompacted waste which the dumpster's volume will accommodate. When a trash compactor is utilized for waste management, a trash compaction apparatus is provided with which is associated a container. As the trash is introduced, it is compressed by the compactor, typically reducing its volume by from three to ten times. This greatly reduces the frequency with which the trash container must be hauled to a landfill or other place of disposal, thereby greatly reducing the cost of disposal.

Typically, when the container is full or partially full, it is loaded on a specially configured truck which may also deliver an empty container to be placed on the trash compactor. The contents of the trash container are transported to a landfill or other suitable disposal site. A further advantage may be accrued by the compaction of the trash in terms of the efficiency with which it may be disposed of by the landfill operation, incineration operation, or the like.

It is known to provide means of varying degrees of complexity to determine when the trash container associated with the compactor is full or nearly full. One common method of determining when the trash compactor is full involves a measurement of the resistive force encountered by the ram which, of course, rises to a high level when the trash in the container has been compacted to nearly the maximum extent possible. Various means have been employed for making a direct or indirect determination of the resistive force encountered by the ram; these include the use of a conventional strain gauge, measurement of the hydraulic fluid pressure, and measurement of the motor current drawn by the pump motor for the compaction equipment hydraulic system.

Although operational control of compaction apparatus in years past was usually implemented by simple switches and relays, there has been a tendency in recent years to employ computer microprocessors and somewhat sophisticated computer programs and algorithms stored in computer memory in or associated with the microprocessor. In computer systems complex algorithms are often employed wherein there were multiple resistive force measurements or wherein the rate of change of the resistive force or the derivative of the signal representing resistive force is employed to endeavor to improve on the measurement of fullness provided by the compactor.

U.S. Pat. No. 4,953,109 to Burgis, U.S. Pat. No. 5,016,197 to Neumann, et al. and U.S. Pat. No. 5,558,013 to Blackstone, Jr. are examples of trash compaction systems utilizing rather complex computer programs to implement the desired control system, including fullness determination, in compaction apparatus. These may be compared with U.S. Pat. No. 3,802,335 to Longo and U.S Pat. No. 4,643,087 to Fenner et al. which do not employ computer microprocessors but execute simple logic with electrical relays.

Trash compactors are typically exposed to harsh environments including wide ranges of outdoor temperatures and potential exposure to power surges. In addition, it is very important that the compaction equipment operate reliably and operate in a safe manner and not be subject to malfunction because of failure or error conditions in its electrical controls. For that reason, there are many users and others who consider that a relatively simple relay based control system has advantages with regard to reliability, durability and safety over available microprocessor controlled compaction systems.

SUMMARY OF THE INVENTION

The present invention departs from the teaching of prior art trash compaction and waste paper baler systems by providing apparatus which is simple, durable, reliable and provides safe and uncomplicated operation for operating personnel. At the same time, it has control features which equal or exceed those of more complex systems and utilizes advanced motor current sensing techniques with calibration adjustment and signal delay features for trouble-free operation and low maintenance requirements.

In general, apparatus of the present invention includes one or two motor current sensing relay switches for detecting and indicating when the compactor container is full or nearly full. These switches do not provide an analog or digital output representing the resistive force on the compaction ram and hydraulic system, but rather a simple on-off indication of when such resistive force exceeds a pre-set calibrated value. An important feature of the apparatus is that the output signal from the switch is delayed for a short predetermined time period, producing certain advantages in operation which will be more fully described hereinafter.

In balers according to the invention, the current sensing relay switch is employed to determine the time at which the baler ram or platen is reversed from extending operation to retracting operation which, of course, depends on the fullness of the bale-forming enclosure of the baler. It should be noted that in neither the trash compactor apparatus nor the baler apparatus is the normal stopping of the ram in the reverse stroke responsive to the current sensing relay switch, but is, rather, controlled by limit switches or position sensing switches responding to ram position, and, in some cases, to time delay devices coordinated with the travel time of the ram.

The apparatus of the invention is capable of receiving additional, optional features which are not a part of the present invention. For example, a purchaser or user may specify an optional multi-cycle control feature whereby the ram of the compactor will extend and retract two or more times at each operation of the compactor ram by pressing the start button. Also an optional feature is available whereby the control system for the compactor is provided with a remote control panel connected by a short cable to the main control unit. Other optional features, some of which are illustrated herein, may or may not be included with apparatus incorporating the basic aspects of present invention.

As compared with using hydraulic pressure for a measure of resistive force on the compactor ram, measurement of motor current offers several advantages. Current sensing devices of varying degrees of sophistication are readily available, many of which have an established record of durability and reliability. Most of such electrical current sensors employ electromagnetic induction to acquire a signal proportional to motor current, hence, it is only necessary to pass one electrical power lead of the pump motor through or around a "donut" electromagnetic transformer sensing device, without requiring any direct electrical connection into the high current, high voltage circuit of the motor. Furthermore, no pressure switch or other means is required in the hydraulic or mechanical system thereby eliminating potential maintenance problems and lack of reliability.

Suitable pressure sensing relay switches may be employed that are compatible with the voltages and currents in conventional electromechanical control systems utilizing relays for the simple control systems of the invention. Thus, there is no necessary requirement that motor current sensors be used with microprocessor controls or vice-versa.

In addition to providing the features and advantages referred to above, it is an object of the present invention to provide compaction apparatus for trash compactors and waste paper balers which have simple relay-implemented control systems including fullness determination and indication that relies on a motor current sensor switch for sensing resistive force encountered by the compaction ram as an indication that the waste container is full or nearly full.

It is another object of the present invention to provide such compaction apparatus wherein the "full" signal from the current sensor relay has an adjustable pre-set time delay so that false "full" indications from momentary surges in current due to acceleration forces or other transient conditions are avoided.

It is still another object of the present invention to provide compaction apparatus in a waste paper baler with simple relay-implemented controls and which employs a motor current sensor switch with a time-delay feature to obtain better, more uniform compaction of waste paper bales.

It is a further object of the present invention to provide such compaction apparatus having a motor current sensor switch with a current level adjustment and indicator light for visual indication of switch operation whereby the operation of such relay may be calibrated to properly coordinate with hydraulic fluid pressure values and settings of relief valves for the hydraulic system.

It is a still further object of the present invention to provide trash compaction apparatus with controls including fullness indication and fullness response that do not rely on measurement of hydraulic fluid pressure or mechanical stress for gauging resistive forces on the compaction ram of the apparatus.

In addition to the features and advantages of the compaction apparatus according to the invention described above, further advantages thereof will be apparent from the following description in conjunction with the appended drawings.

DETAILED DESCRIPTION OF THE PREFERRED EMBODIMENTS

Figure 1A:
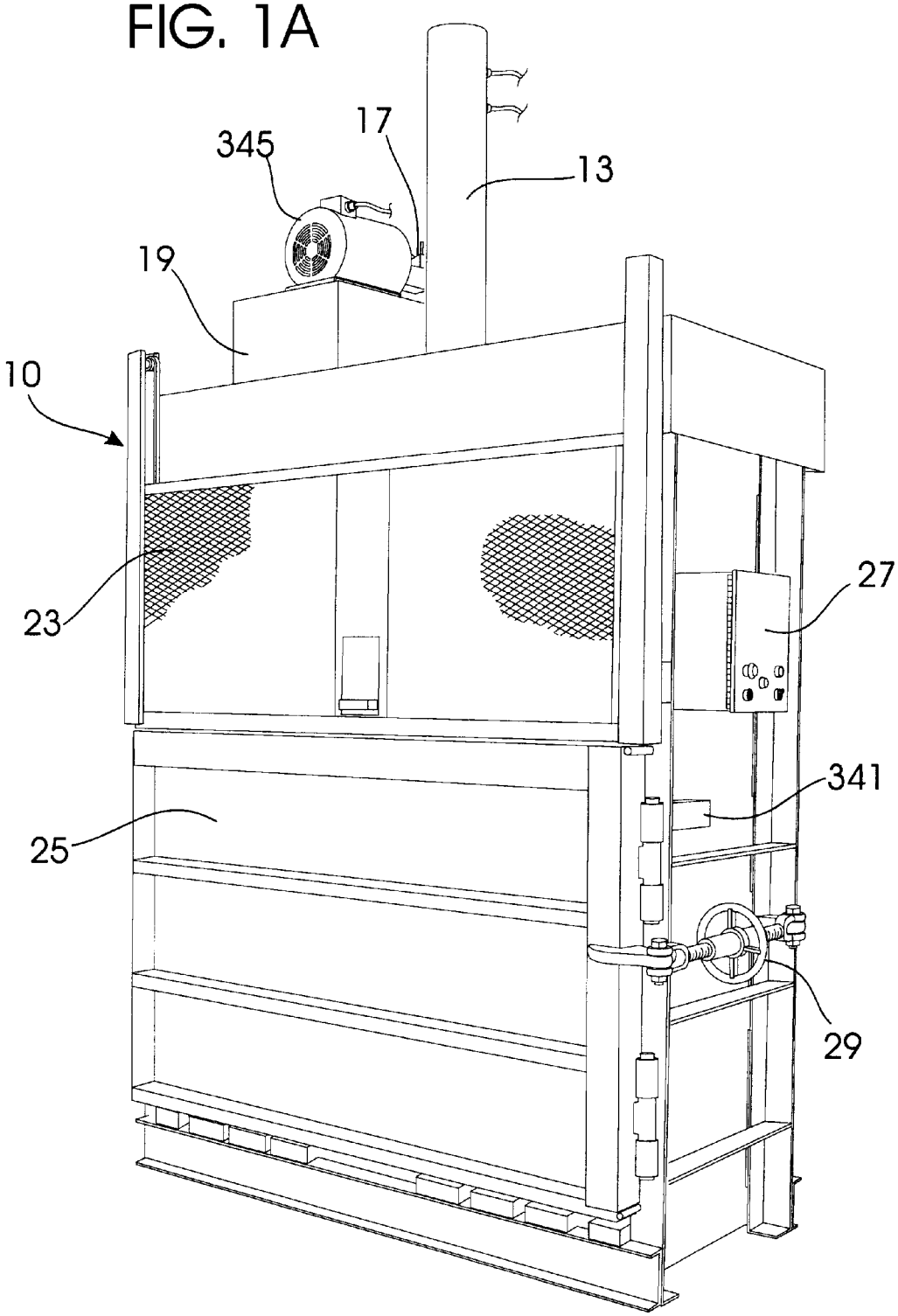
FIG. 1A is an isometric view of a baler according to the present invention.
Figure 1B:
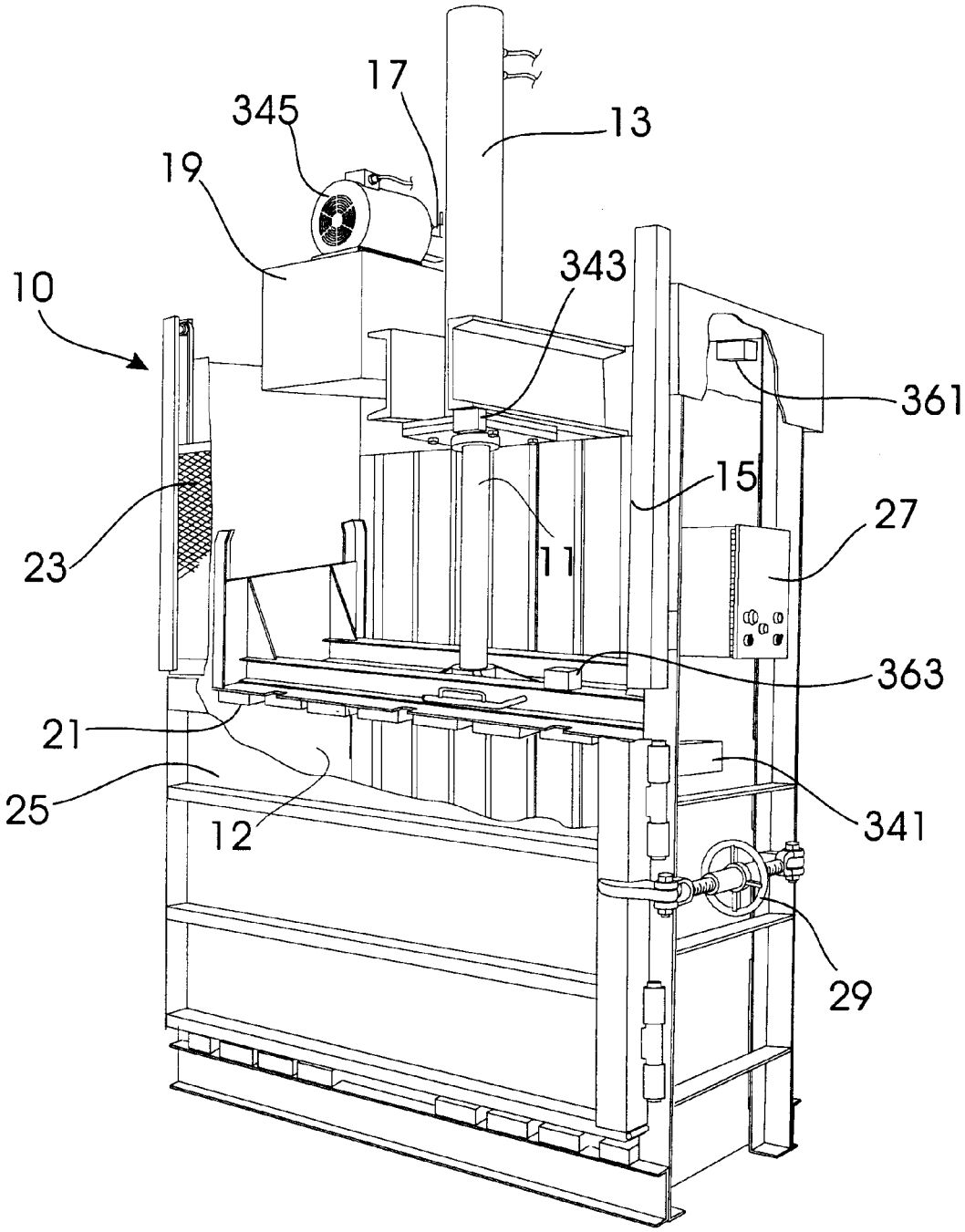
FIG. 1B is a partially schematic isometric view of the apparatus of FIG. 1A broken away to show functional elements thereof.

Referring to the drawings and, particularly to FIGS. 1A and 1B, compaction apparatus 10 is shown in the form of a vertical waste paper baler having a ram 11 operating to compact materials in enclosure 12. Ram 11 is actuated by a hydraulic cylinder 13, powered by a pump 17, operated by motor 345. Motor 345 will typically be a three-phase electric motor operating on 120v to 440v with a power rating of at least three horsepower.

Motor 345 is provided with a starter unit and also appropriate safety devices, such as fuses or circuit breakers all in accordance with normal practice in the art. These elements forming no part of the invention generally are not shown. Similarly, hydraulic cylinder 13 has associated therewith conventional solenoid valves, relief valves and other conventional elements (not shown) along with hydraulic fluid reservoir housing 19. Ram 11 includes a platen 21 which applies the compressing force to waste paper, typically corrugated paper board, in the enclosure 12. Other significant features of the baler, such as bale ejection apparatus, form no part of this invention and are not shown. It will be understood that the general operation of the baler is similar to that shown in U.S. Pat. No. 4,232,599 issued Nov. 11, 1980, to Ulrich.

The ram 11 with platen 21 is shown in FIG. 1B in an intermediate position whereas the normal rest position for the platen 21 would be at its maximum height for accepting waste paper through access opening 15.

Loading door 23 slides upward to provide access through access opening 15; loading door switch 343 and interlock switch 363 act as sensors for the position of the loading door 23 to provide safe operation of the compaction apparatus, all in accordance with practice in the industry.

Chamber door 25 forming a part of enclosure 12 is hinged at the side and may be opened when waste material has been compressed to form a full bale at which time the bale may be secured by ties in conventional manner and removed from the baler by ejection apparatus. Chamber door switch 341 provides a proximity sensor for indicating that chamber door 25 is in the closed position.

Controls for the safe and reliable operation of the compaction apparatus 10, later to be described, are located in control box 27. A platen switch 361 is provided for sensing the retracted position of platen 21 and ram 11.

The operation of the baler shown in FIGS. 1A and 1B is generally conventional as will be apparent to those skilled in the art. Generally, the ram 11 and the platen 21 reside in the upward or fully retracted position while awaiting deposit of material to be compacted. Chamber door 25 is closed and locked as by the hand wheel lock mechanism 29 or some other suitable locking means appropriate to forces imparted to door 25 in the compaction process. With loading door 23 raised to its upward position for access to the interior of the baler, waste material is deposited in the baler underneath the platen 21. As the baler becomes full of uncompacted material, the controls on control panel 27 are set to turn the baler on, if necessary, and a START button is used to initiate a compaction cycle. Ram 11 and platen 21 descend and compress the waste material until the resistive force indicates adequate compaction at which time the ram 11 and the platen 21 return to the upward, retracted position.

This process is repeated until a bale of waste material of the desired size is formed, at which time ties are put around the bale in a known manner. With chamber door 25 open, ram 11 is operated and used as a lift mechanism to operate an ejection device for tipping the bale out of the compactor. The ejection device forms no part of the present invention and is not shown and described herein. After removal of a bale from the baler, chamber door 25 is closed and locked and the baler is restored to the condition for accepting waste material to form another bale.

Figure 2:
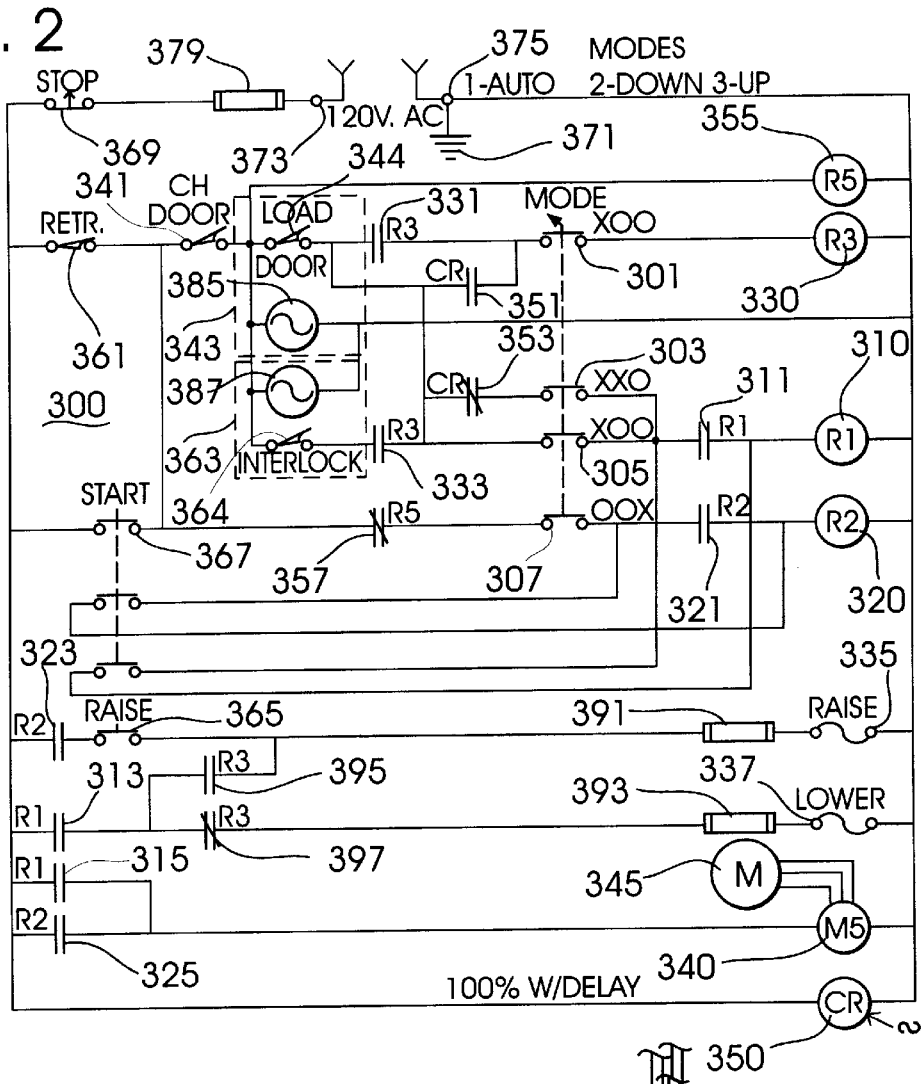
FIG. 2 is a schematic diagram of electrical and electromechanical components of the apparatus of FIG. 1A.
Figure 3:
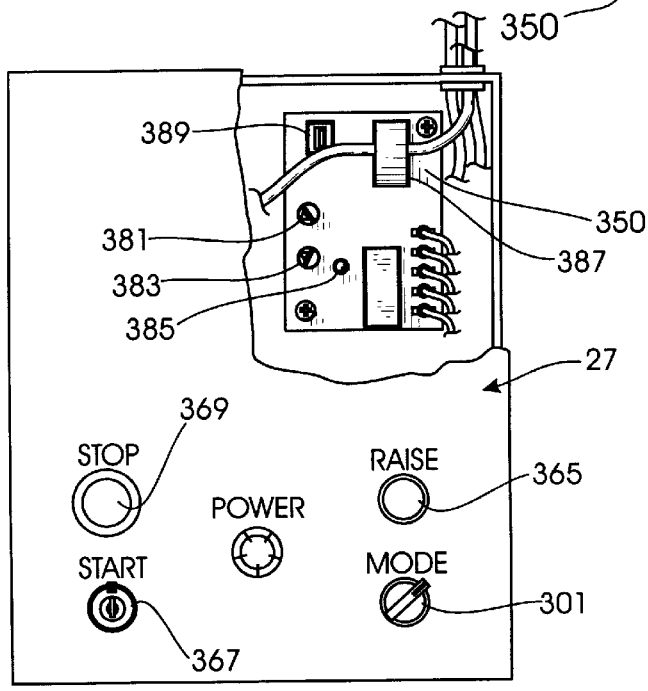
FIG. 3 is an enlarged, elevational view of the control panel of FIG. 1A broken away to show internal components.

A schematic circuit diagram for the baler 10 is shown in FIG. 2 while FIG. 3 is an enlarged view partially broken away of the control box 27 of FIGS. 1A and 1B. The operation of the circuit of the control system for baler 10 shown schematically in FIG. 2 will be understood more readily be reference to a table below entitled Baler Circuit as well as the following description.

BALER CIRCUIT

| | START | RAISE | RETR. | RELAY | | | | | MOTOR | EXT. | RETR. |
|---|---|---|---|---|---|---|---|---|---|---|---|
| DEVICE | PB | PB | LS | R1 | R2 | R3 | R5 | CURR. | CONT. | SOLEN. | SOLEN. |
| MODE AUTO 301 = Y 303 = Y 305 = Y 307 = N | | | | | | | | | | | |
| IDLE | NO | NO | YES | NO | NO | NO | NO | NO | NO | NO | |
| BEGIN | YES | NO | YES | YES | NO | NO | YES | NO | YES | YES | NO |
| EXTENDING | NO | NO | NO | YES | NO | NO | YES | NO | YES | YES | NO |
| EXTENDED | NO | NO | NO | YES | NO | YES | YES | YES | YES | NO | NO |
| RETRACTING | NO | NO | NO | YES | NO | YES | YES | NO | YES | NO | YES |
| RETRACTED | NO | NO | YES | NO | NO | NO | NO | NO | NO | NO | NO |
| MODE DOWN 301 = N 303 = Y 305 = N 307 = N | | | | | | | | | | | |
| IDLE | NO | NO | NO | NO | NO | NO | NO | NO | NO | NO | NO |
| BEGIN | YES | NO | NO | YES | NO | NO | NO | NO | NO | NO | NO |
| EXTENDING | NO | NO | YES | YES | NO | NO | YES | NO | YES | YES | NO |
| EXTENDED | NO | NO | YES | NO | NO | NO | YES | YES | YES | NO | NO |
| RETRACTING | NO | NO | YES | NO | NO | NO | YES | NO | NO | NO | NO |
| RETRACTED | NO | NO | NO | NO | NO | NO | NO | NO | NO | NO | NO |
| MODE UP 301 = N 303 = N 305 = N 307 = Y | | | | | | | | | | | |
| IDLE | NO | NO | NO | NO | NO | NO | NO | NO | NO | NO | NO |
| BEGIN | YES | NO | YES | NO | YES | NO | NO | NO | YES | NO | NO |
| EXTENDING | NO | NO | YES | NO | NO | NO | NO | NO | NO | NO | NO |
| EXTENDED | NO | NO | YES | NO | NO | NO | NO | NO | NO | NO | NO |
| RETRACTING | NO | YES | YES | NO | YES | NO | NO | NO | YES | NO | YES |
| RETRACTED | NO | NO | NO | NO | NO | NO | NO | NO | NO | NO | NO |

Power is supplied to the circuit 300 of FIG. 2 at terminals 373 and 375 and is preferably 120V AC power. Normally the electric motor powering the pump for the hydraulic system will be provided with three-phase power and the single phase AC power, nominally of 120V, may be extracted from the three-phase power by a conventional transformer not shown in FIG. 2. Alternatively, a different voltage of AC or DC power may be utilized to power the circuit 300. The three-phase power for pump motor 345 is shown schematically and only the controller for the motor in the form of motor starter 340 is actually an operative part of the circuit of FIG. 2. It may also be noted that at least one of the conductors supplying current to motor 345 is inductively coupled to current relay 350 as indicated in FIG. 2 and in FIG. 3.

It should be noted in the circuit diagram of FIG. 2 (and also in the circuit diagrams later to be described) that, in addition to a current relay, there are additional relays (in FIG. 2 including relay 310, relay 320, relay 330, and relay 355). These relays are also designated R1, R2, R3, and R5, respectively, and the normally open or the normally closed contacts of each relay in the circuit diagram are marked to correspond to the designation of the relay which causes them to operate. For the current relay 350 the designation is CR.

It will be noted that terminal 375 is designated the ground terminal for the circuit and is connected to ground 371. Conventional fuse protection indicated by fuse 379 is included in the circuit and a stop button 369 is provided to quickly remove all power from the circuit. While stop button 369 may be used to turn on and turn off the control circuit, often an additional main on-off switch, not shown in FIG. 2, will be provided. When the circuit is supplied with power and is on, it will be in an idle condition until start button 367 is activated. As seen in FIG. 2, there are three momentary contacts associated with the start button 367. It is desirable in many cases to utilize a key lock switch to prevent the baler from being operated by unauthorized personnel. The start button 367 may also include a previously mentioned main power off switch (not shown). Limit switch 361 is the retract limit switch which is closed when the ram and pressure head of the baler are fully retracted.

Various interlock switches are provided which do not affect normal operation of the system provided that the chamber door and the loading door are in the proper position for the particular operation. Interlock switch 341 is the chamber door limit switch while interlock device 343 for the loading door and interlock device 363 for the loading door are preferably proximity switches having respective infrared light sources 385 and 387. While current passing devices for interlock 343 and interlock 363 preferably are solid state devices, they are schematically shown as contacts 344 and 364.

In this description of the schematic diagram of FIG. 2 and its operation, it is assumed that it will initially be set in the automatic mode. The mode control switch 301 includes three other contacts 303, 305, and 307. As shown in FIG. 2 there are three modes, namely 1) auto, 2) down, and 3) up. The operation of switch contacts 301, 303, 305, and 307 is indicated by respective series of three symbols of X or O indicating whether the particular contact is closed (X) or open (O) for each of the modes auto, down, and up. For example, contact 303 is closed in the auto mode, is closed in the down mode and is open in the up mode, as indicated by the legend XXO.

As seen in the Baler Circuit table below, in the idle condition (before the start button 367 is pushed) none of the relays, R1, R2, R3, R5, or CR (current relay) are operated. Thus, in the idle condition, contacts 331, 351, 311, 333, 321, 335, 313, 315, and 325 are open; contacts 353, 357 and 337 are closed. In the idle condition and throughout the auto mode operation, contacts 301, 303 and 305 are closed while contact 307 is open.

Referring to the Baler Circuit table, to begin the operation, the start button 367 is activated. Preferably the start "button" is a momentary spring return key operated switch, but for the functionality of the circuit any momentary multiple contact switch as indicated in FIG. 2, would be equivalent. As shown in the Baler Circuit table, activating Start button 367 causes actuation of R1 relay 310 and R5 relay 355; it also causes actuation of motor starter 340 of the motor control.

After the ram has started extending, retract limit switch 361 assumes its normally closed position, and the start button 367 is released and no longer activated. At some point determined by the fullness of the baler, the ram 11 and platen 21 (press head) encounter substantial resistance causing an increase in hydraulic pressure with a corresponding increase in motor current and motor torque. This increase in current is sensed by the current relay 350 and, after a predetermined time delay of about 1 second to 6 seconds, current relay 350 closes and the ram is in fully extended position. Thereupon (extend) lower solenoid 337 (as indicated schematically in FIG. 2) is deactivated. Note that in the vertical baler mechanism 10 "raise" equates to retract and "lower" equates to extend.

After the short delay predetermined by the current relay 350, the baler is controlled by baler control circuit 300 to begin the retract cycle at which time (retract) raise solenoid 335 is activated. Note that solenoid 335 and solenoid 337 are provided with fuses 391 and 393 in a conventional manner and their selection is basically determined by contacts 395 and 397 of relay R3. The retract portion of the cycle is terminated when the ram reaches the fully retracted position and retract limit switch 361 is operated to open the contacts thereof. At this time, all relays, R1, R2, R3, and R5 together with the current relay are deactivated with the result that the control circuit 300 is returned to the original idle condition. It is customary to include in the control unit for the baler provisions for manually rasing and manually lowering the ram and press head, primarily for the purpose of using the hydraulically operated ram to power the ejection mechanism for the baler. See U.S. Pat. No. 4,232,599 to Ulrich.

The sequence for the manual up and for the manual down operations are shown in the Baler Circuit table below. It should be noted that the interlock switches 341, 343, and 363 are required to be properly positioned for the manual down and the manual up operations. In the manual down operation, only chamber door interlock switch 341 and loading door interlock switch 343 are actuated while interlock switch 363 is not. In the manual up operation (primarily used for ejecting a bale from the baler) none of the interlock switches 341, 343, or 363 are actuated. The operation of the circuit 300 of FIG. 2 does not critically depend on the manual down or the manual up operation as respects the present invention and, thus, these operations will not be discussed in greater detail.

From the foregoing description, the general operation of the control circuit 300 of FIG. 2 will be understood, but it is also important to understand the particular advantages in utilizing a current relay 350 with an adjustable delay feature and an adjustable threshold feature as a position sensing and/or fullness sensing device (rather than a hydraulic pressure switch commonly used heretofore). A current relay, sometimes referred to as an overcurrent relay, is a readily available unit for use in a wide variety of controlled systems. Information regarding such current relays (termed current sensor/controls) can be found at www.ssac.com, for example.

An important feature of the current relay 350 is the adjustable time delay set with control 381 is shown in FIG. 3. Current sensors with delay ranges of from a fraction of a second to approximately one minute are readily available, and, in the present application, the setting is approximately one second or within the range of from 1 sec. to 6 secs. It has been found very desirable for the ram and platen of the Baler (and those of other compaction apparatus) to remain in the pressure exerting mode for a significant time before stopping and/or reversing after the threshold value of current for the current relay 350 is reached. This has several desirable effects. One such effect is that the current relay becomes essentially free of false signals due to momentary increases in motor current not caused by the continuing resistive force of the material being compacted in a normal manner. Such current surges may be caused by high motor starting current, power line surges, presence of foreign objects temporarily obstructing the ram motion or some combination of these. Switch 389 is an over-current, under-current switch set to over-current at all times for proper operation of the circuits of FIGS. 2, 5, and 7.

The delay associated with the current relay also tends to improve the compaction of the material by postponing reversal or stopping of the ram until the full force of the hydraulic system has been applied to the material long enough to achieve optimal volume reduction of the material. Normally, the time delay control 381 will not be adjusted by user or operator personnel and will be set at the factory. The user may request a desired delay setting deemed to be appropriate for the application for which the baler is being used.

Factory calibration is also employed to set the current level threshold control 383. This is a process made relatively simple by the threshold control 383 and an LED indicator light 385 which indicates when current relay 350 actuates. The conventional hydraulic system as employed in compaction apparatus such as the baler 10 has an adjustable relief valve which determines the maximum hydraulic pressure that can be built up in the cylinder 13. The relief valve may be set for a pressure of 2500 psi, for example. In such case it may be desired to set the so called 100% pressure value at which the current relay 350 actuates to a value corresponding to a pressure of 2000 psi (80% of the maximum allowed pressure).

To carry out the calibration of the current relay 350 and the current threshold control 383 in the above example, one may activate the system with the ram stalled in the extending mode for a maximum pressure buildup while reducing the hydraulic fluid pressure by adjusting the relief valve to achieve the desired value of 2000 psi. Current threshold control 383 is then reduced from the maximum setting toward lower settings until indicator light 385 shows that the current relay 350 has actuated. The proper setting for current threshold control 383 has then been determined and the hydraulic pressure relief valve may be reset to its normal setting (e.g. 2500 psi), at which time the calibration is complete.

Figure 4A:
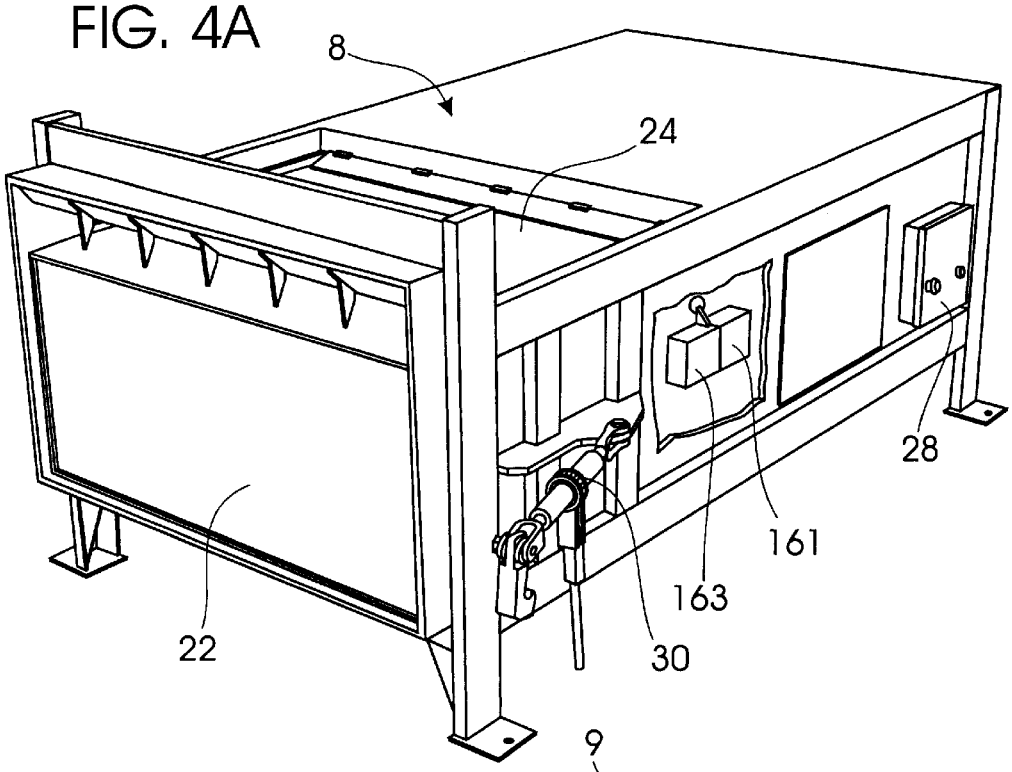
FIG. 4A is an isometric view of a stationary compactor according to the invention.
Figure 4B:
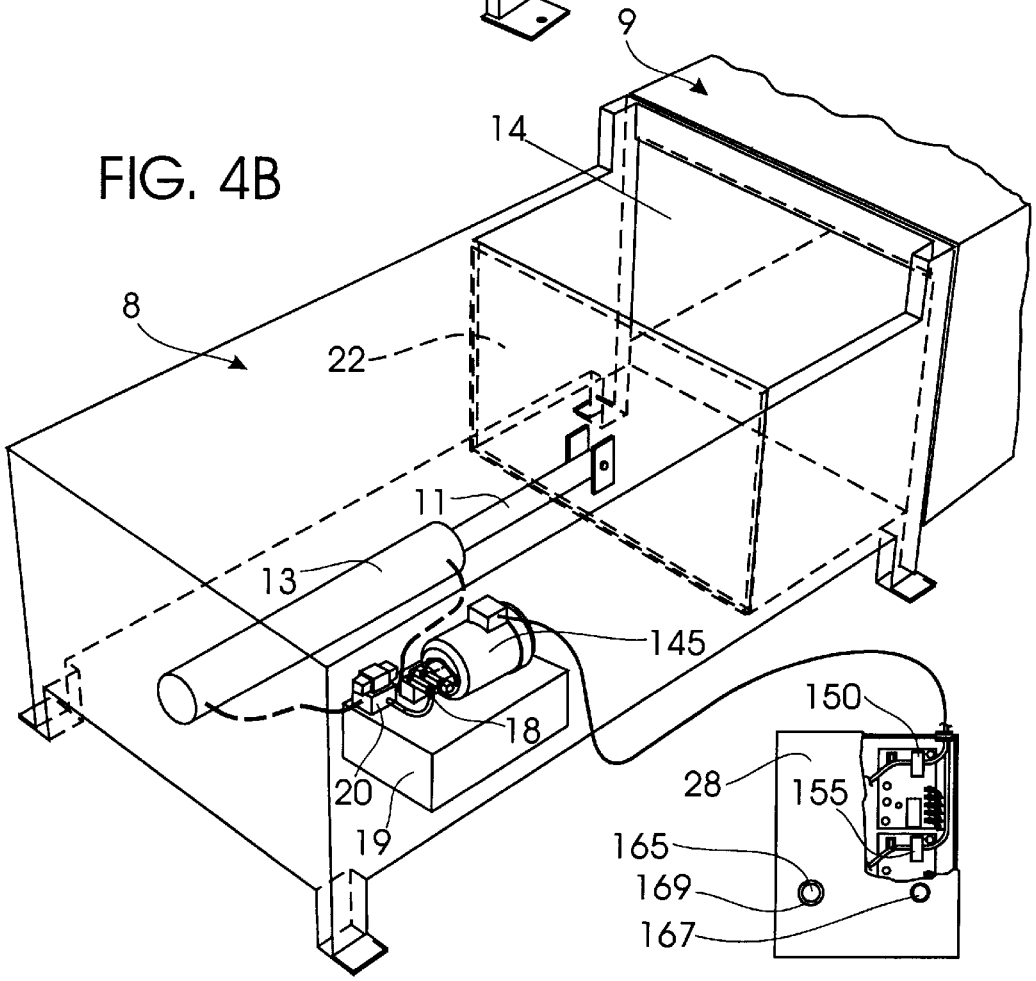
FIG. 4B is a partially schematic isometric view of the apparatus of FIG. 4A broken away to show functional elements thereof.
Figure 5:
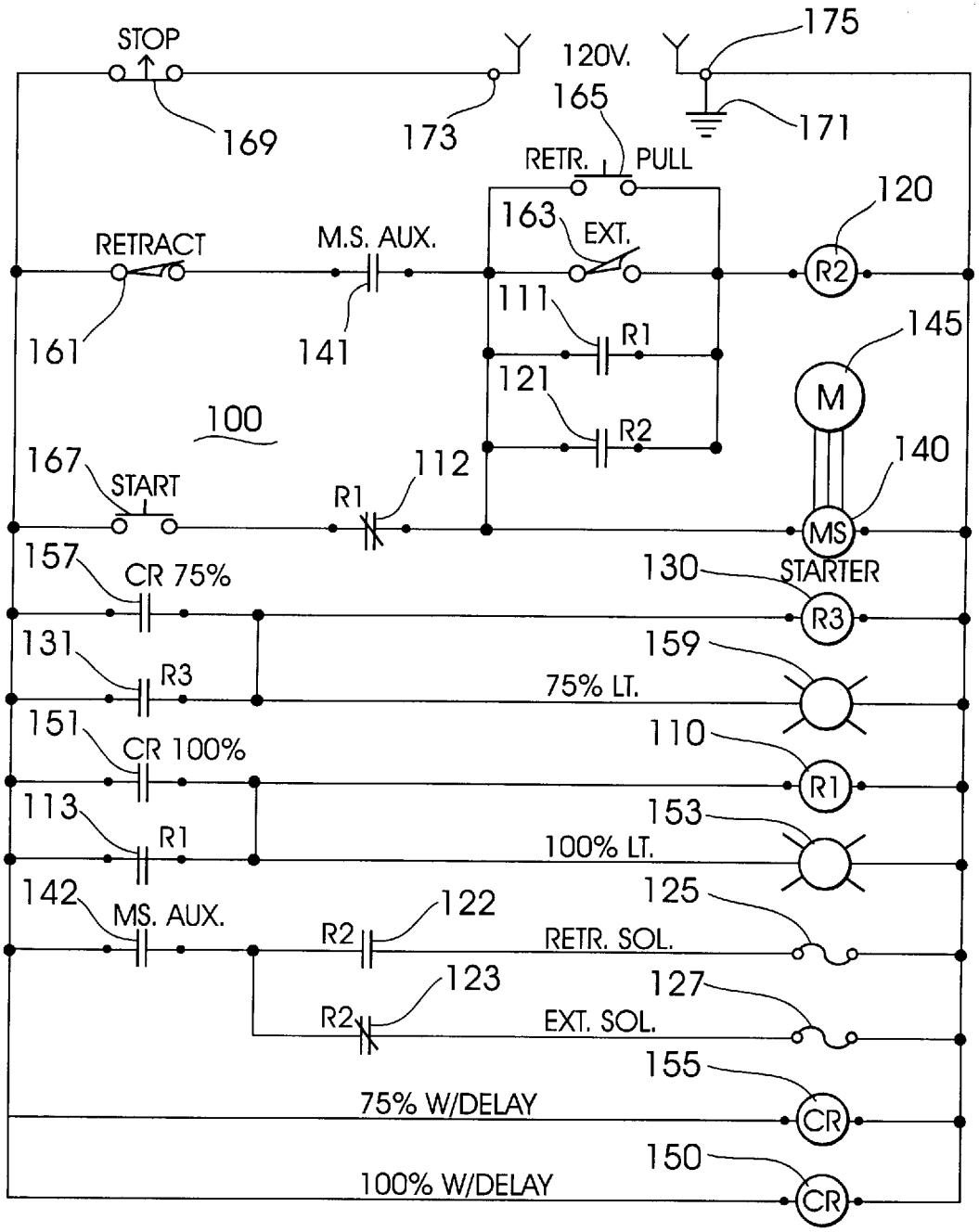
FIG. 5 is a schematic diagram of electrical and electromechanical components of the apparatus of FIG. 4A.

Referring to FIG. 4A, FIG. 4B, and FIG. 5, a stationary standard compactor 8 is shown having associated therewith a removable trash container 9 which contains an electrical ram motion control responsive to motor current according to the present invention and generally similar to that described with reference to FIG. 1A, FIG. 1B, FIG. 2, and FIG. 3. While the function of the baler in FIGS. 1A through FIG. 3 is to compact and bale paperboard or cardboard suitable for recycling, the function of the apparatus of FIGS. 4A through FIG. 5 is to compact trash, paper and other materials into a container which may be transported with minimal expense to a recycling location or more often to a landfill.

It will be understood that the apparatus shown in FIG. 4A and FIG. 4B is a basic form of trash compactor which in actual use might be provided with many optional features. Such optional features are generally known in the art and do not specifically relate to the present invention, for which reason they are not shown or described herein. Also there are standard safety features which are desirable or required to be present and, such features being common and well-known, are not described in detail.

Compactor 8 has a ram 11 with a platen 22 driven by a reversible hydraulic cylinder 13. Pressurized fluid is applied to cylinder 13 from a pump 18 driven by an electric motor 145 which is typically a 440V three-phase motor of approximately 5 hp. A hydraulic control box 19 is provided for the fluid reservoir and may have associated hydraulic system controls including solenoid operated valves 20 and the like thereon. These elements of the system are generally conventional and will not be described in detail. As shown in FIG. 4A, an access opening closure 24 is closed while the platen 22 is not in a retracted position. A conventional latching and locking mechanism 30 firmly secures the trash container 9 to the compactor 8 while permitting it to be unlatched, removed and replaced when desired.

As shown schematically in FIG. 4A and in FIG. 5, a retract limit switch 161 and an extend limit switch 163 serve to sense the presence of the ram and platen at the fully retracted or at the fully extended position. A control box 28 houses electrical control elements and provides control buttons including stop button 169, start button 167, and retract button 165. Typically, retract button 165 may be a pull-to-retract element associated with stop button 169 which is a press-to-stop button. As shown in FIG. 4B and in FIG. 5, current relay 150 (similar to current relay 350 of FIGS. 2 and 3) is an important element of the control circuit for stationary compactor 8. The control circuit for stationary compactor 8 includes an optional second current relay 155 which is set for 75% current rather than 100% current and provides an indication that the compactor is nearly full.

In the following discussion of the circuit 100 of FIG. 5 it is useful to also refer to the table entitled Stationary Compactor Circuit below. In addition to the current relays 150 and 155 mentioned above which are designated CR 100% and CR 75%, the circuit 100 includes relay 110 designated R1, relay 120 designated R2, and relay 130 designated R3. Motor starter 140, designated MS, also has auxiliary contacts designated MS. AUX.

STATIONARY COMPACTOR CIRCUIT

| Device Operated = Yes | Start PB | Retr. PB | Retr. Lim Sw. N.C. | Ext. Lim. Sw. N.O. | R1 Relay | R2 Relay | R3 Relay | Mot. St. Aux. | Ext. Solen | Retr. Solen | 100% Curr Relay |
|---|---|---|---|---|---|---|---|---|---|---|---|
| NO LOAD | | | | | | | | | | | |
| IdIe | NO | NO | YES | NO | NO | NO | NO | NO | NO | NO | NO |
| Begin | YES | NO | YES | NO | NO | NO | NO | YES | YES | NO | NO |
| Extending | NO | NO | NO | NO | NO | NO | NO | YES | YES | NO | NO |
| Extended | NO | NO | NO | YES | NO | YES | NO | YES | NO | YES | NO |
| Retracting | NO | NO | NO | NO | NO | YES | NO | YES | NO | YES | NO |
| Retracted | NO | NO | YES | NO | NO | NO | NO | NO | NO | NO | NO |
| RETR. PB | | | | | | | | | | | |

-continued

STATIONARY COMPACTOR CIRCUIT

| Device Operated = Yes | Start PB | Retr. PB | Retr. Lim Sw. N.C. | Ext. Lim. Sw. N.O. | R1 Relay | R2 Relay | R3 Relay | Mot. St. Aux. | Ext. Solen | Retr. Solen | 100% Curr Relay |
|---|---|---|---|---|---|---|---|---|---|---|---|
| During Ext. | | | | | | | | | | | |
| Idle | NO | NO | YES | NO | NO | NO | NO | NO | NO | NO | NO |
| Begin | YES | NO | YES | NO | NO | NO | NO | YES | YES | NO | NO |
| Extending | NO | YES | NO | NO | NO | YES | NO | YES | YES | NO | NO |
| Extended/ Partly | NO | YES | NO | NO | NO | YES | NO | YES | NO | NO | NO |
| Retracting | NO | NO | NO | NO | NO | YES | NO | YES | NO | YES | NO |
| Retracted | NO | NO | YES | NO | NO | NO | NO | NO | NO | NO | NO |
| LOAD 100% During Ext. | | | | | | | | | | | |
| Idle | NO | NO | YES | NO | NO | NO | NO | NO | NO | NO | NO |
| Begin | YES | NO | YES | NO | NO | NO | NO | YES | YES | NO | NO |
| Extending | NO | NO | NO | NO | YES | NO | YES | YES | YES | NO | YES |
| Extended/ Mostly | NO | NO | NO | NO | YES | YES | YES | YES | NO | NO | YES |
| Retracting | NO | NO | NO | NO | YES | YES | YES | YES | NO | YES | NO |
| Retracted | NO | NO | YES | NO | YES | NO | YES | NO | NO | NO | NO |

Note Start Button Disabled by R1 = Yes

Circuit 100 has a stop button 169 which disconnects all power when it is actuated and may serve as an on-off switch. There will normally be at least one other main power switch (not shown) for circuit 100. 120V power from a transformer or other suitable source is provided at terminals 173 and 175 with terminal 175 being connected to a ground 171. A single-pole momentary start button 167 initiates the operation of a compaction cycle. An optional feature may be added to the circuit 100 for stationary compactor 8 which will allow the operator to select a mode of operation in which two or more cycles of compaction can be performed with one actuation of the start button. This optional feature being unnecessary to the present invention it is not described herein.

Prior to actuation of start button 167 when the circuit 100 is in the idle condition, none of the relays 110, 120, 130, or the auxiliary contacts for starter 140 are activated. Retract limit switch 161 which is normally closed is actuated (open) during the idle condition when the ram and platen are retracted.

Upon actuation of start button 167, motor starter 140 causes motor 145 to start and also causes actuation of motor starter auxiliary contacts. Accordingly, contacts 141 are closed and contacts 142 are closed, thereby actuating an extend solenoid 127. The contacts of relays R1, R2 and R3 remain in the same state as in the idle condition. That is, contacts 112 and 123 are closed, while contacts 131, 113, 151, 157, 111 and 121 are open.

After start button 167 is released (opening the contacts thereof) and while the ram is extending, there will be no change of state of any of the relays or contacts until the ram is fully extended (assuming that the container for the compactor is not full). When the ram is extended, the extend limit switch 163 which is normally open becomes closed. This action causes relay R2 to be activated and retract solenoid 125 to be operated; concurrently extend solenoid 127 is deactivated. During the retracting portion of the cycle, extend limit switch 163 opens; there is no change of state for the various relays and their contacts.

When the fully retracted position is achieved, retract limit switch 161 is actuated opening the contacts thereof and, in view of the fact that start button 167 is not then depressed, all relays and contacts thereof are restored to the original status in the idle condition.

It should be noted as of particular importance that current relay 150 in FIG. 5, like current relay 350 in FIG. 2, has a delay feature wherein it may be set to actuate from 1 second to 6 seconds after the motor current reached and remained above the threshold current level set for the current relay. The particular advantages of utilizing a current relay with an adjustable delay feature and an adjustable threshold feature as a fullness sensing device are described in connection with the control circuit 300 of FIG. 2 and that description may be considered to be incorporated by reference here.

Factory calibration to set the current level threshold for the current relay 150 (and also the current relay 155) is similar to and will be understood from the explanation of setting the current level threshold for current relay 350 of circuit 300 and FIGS. 2 and 3. Such explanation of factory calibration may be considered to be incorporated by reference here.

The operation of 75% current relay 155 is not detailed in the Stationary Compactor Circuit table but may readily be seen from FIG. 5. It is preferred that the 75% relay 155 be set with the same delay of about 1 second, or, in any event, between about 1 second and about 6 seconds for reasons stated above with respect to current relay 150 and current relay 350, but in particular to avoid false indications from 75% current relay 155 due to motor starting current. When the 75% current relay 155 actuates to complete a current path through contacts 157 and cause the 75% light 159 to be illuminated, it is desirable that light 159 remain illuminated until power is disconnected from circuit 100. This function is performed by R3 relay 130 with contacts 131 serving as a latching relay to maintain light 159 illuminated.

This is similar to the function of R1 relay 110 with its contacts 113 to maintain illumination of 100% light 153. It should be noted, however, that R1 relay 110 also has contacts 112 which open the circuit of start button 167. Accordingly, further operation of the compactor is prevented upon actuation of the 100% current relay 150 while 75% current relay 155 only causes illumination of 75% light 159 and allows continued operation of the compactor by actuation of start button 167. This is shown in the Stationary Compactor Circuit table indicating disablement of the start button after a cycle in which the 100% load detected by current relay 150 causes actuation of R1 relay 110.

Figure 6:
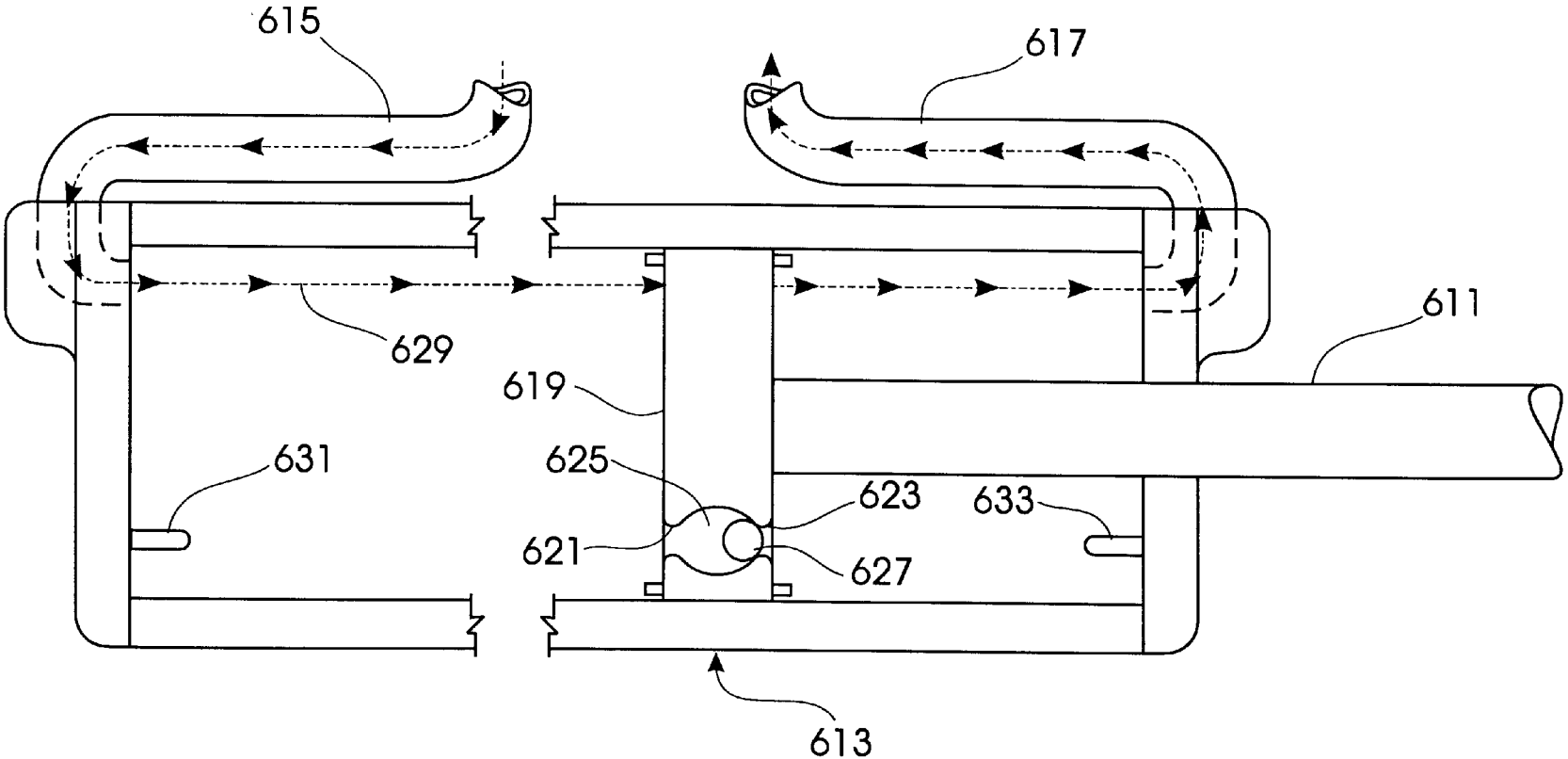
FIG. 6 is a mechanical schematic diagram of a hydraulic cylinder with internal limit valve useful in self-contained compactors according to the invention.
Figure 7:
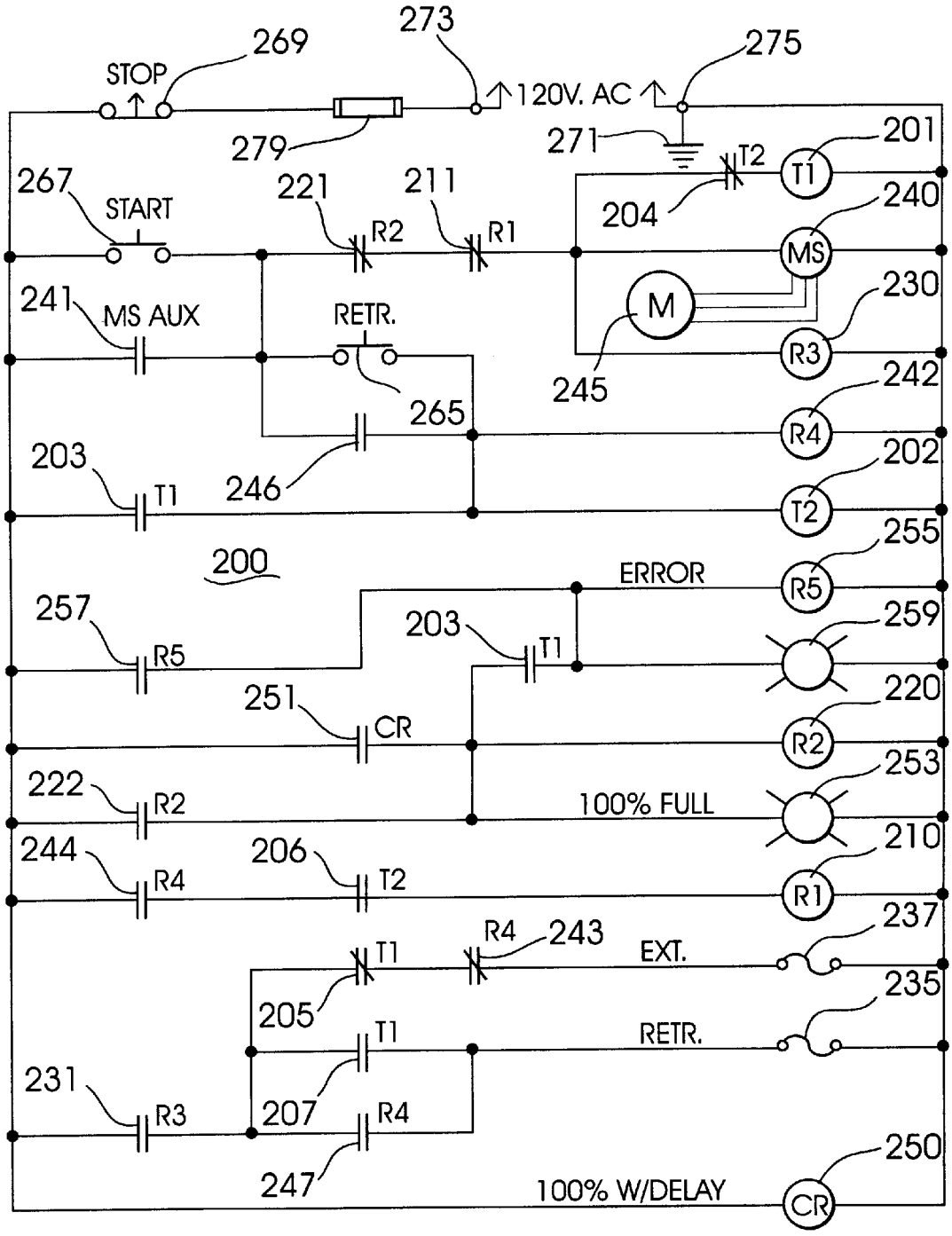
FIG. 7 is a schematic diagram of electrical and electromechanical components of a self-contained compactor according to the invention.

FIG. 7 is a schematic circuit diagram for a self-container compactor, the operation of which is somewhat different than the stationary compactor, and FIG. 6 is a schematic showing of a distinctive form of hydraulic cylinder which is an essential feature of the self-contained compactor. Except for the hydraulic cylinder with limit valves shown in FIG. 6, these self-contained compactors do not have important functional features beyond those described above with reference to FIGS. 1A, 1B, 4A, and 4B, and thus the overall physical configuration of such compactors is not illustrated or described in detail.

Referring now to FIG. 6, a hydraulic cylinder 613 is shown of a form having internal limit valves. Hydraulic cylinder 613 has a shaft 611 for driving the ram of a self-contained compactor (not shown). Cylinder 613 and ram-driving shaft 611 would, in effect, replace the form and function of cylinder 13 and ram 11 in FIG. 4-B, for example. Hydraulic fluid under pressure is provided to cylinder 613 through conduits 615 and 617. Conduit 615 would be pressurized in the extend mode of operation for the cylinder as determined by a solenoid valve in a manner previously explained. In such case, conduit 617 would act as the return path for hydraulic fluid exiting the cylinder. When the conventional solenoid valve reversed the fluid flow from that shown in FIG. 6 by pressurizing conduit 617, the hydraulic cylinder 613 would be in the retract mode. With a conventional hydraulic cylinder not provided with limit valves as is cylinder 613, it is very undesirable for the piston with the hydraulic cylinder to remain forcefully pressed at one end or the other of the cylinder under the full pressure of the hydraulic system for a sustained length of time. As noted in the foregoing description of FIG. 1-A through FIG. 5, it is usually desirable to prevent such sustained bottoming out of the hydraulic cylinder piston by providing limit switches or other means to cause reversal of pressure on the cylinder piston when it reaches the end of it's travel. With the hydraulic cylinder 613 this problem is dealt with in a different manner by providing limit valves rather than limit switches.

Piston 619 is formed with a valve seat 621 and a valve seat 623. A chamber 625 connecting valve seats 621 and 623 contains a ball 627 which tends to seat against the valve seat 623 when conduit 615 is pressurized and which tends to seat against valve seat 621 when conduit 617 is pressurized. Accordingly, when piston 619 is not at an extreme position, the opening through valve seats 621 and 623 is effectively closed by ball 627 being seated in one of the two seats and piston 619 operates as if the limit valve represented by ball 627 and valve seats 621 and 623 were not present. On the other hand, when piston 619 reaches the extreme rightward position under influence of the flow and pressure indicated by arrows 629, ball 627 is displaced by a protrusion 633 allowing the hydraulic fluid to pass through valve seat 621 and valve seat 623 without exerting a significant degree of pressure on piston 619. Incorporation of a hydraulic cylinder 613 with a limit valve arrangement relieves any problem regarding long sustained grounding out of the piston and the ram, making electrical limit switches unnecessary for that purpose. It should be pointed out that the showing in FIG. 6 is strictly schematic and that the actual physical structures of well-known and readily available hydraulic cylinders having this feature will vary widely and usually be different than the structure shown in FIG. 6.

Referring now to FIG. 7 showing a typical schematic diagram of the electrical circuit for a self-contained compactor according to the invention, it will first be noted that there is no reliance upon electrical limit switches as was the case with the circuit of FIG. 2 and the circuit of FIG. 5. Rather, in the circuit 200 of FIG. 7 there is a T1 time delay relay 201 and a T2 time delay relay 202. The time delay for time delay relay 201 and time delay relay 202 is set at an appropriate value slightly greater than the time required for the ram driven by the cylinder 613 to move from fully extended to fully retracted position or vice versa under normal operating conditions. Typically, this time will be between 20 and 25 seconds or about 22 seconds. It is useful to refer to the table entitled Self-Contained Compactor Circuit below in addition to FIG. 7 and the following description.

SELF-CONTAINED COMPACTOR CIRCUIT

| | ON-STOP | START | RETR. | RELAY | | | | | | | MOT. START | EXT. | RETR. |
|---|---|---|---|---|---|---|---|---|---|---|---|---|---|
| DEVICE | PB | PB | PB | R1 | R2 | R3 | R4 | T1 | T2 | CR | AUX | SOLEN | SOLEN |
| NO LOAD | | | | | | | | | | | | | |
| IDLE | YES | NO | NO | NO | NO | NO | NO | NO | NO | NO | NO | NO | NO |
| BEGIN | YES | YES | NO | NO | NO | YES | NO | YES | NO | NO | YES | YES | NO |
| EXTENDING | YES | NO | NO | NO | NO | YES | NO | YES | NO | NO | YES | YES | NO |
| EXTEND/TIMED | YES | NO | NO | NO | NO | YES | NO | YES | YES | NO | YES | NO | NO |
| RETRACTING | YES | NO | NO | NO | NO | YES | NO | YES | YES | NO | YES | NO | YES |
| RETRACT/TIMED | YES | NO | NO | NO | NO | NO | NO | NO | NO | NO | NO | NO | NO |
| RETRACT PB DURING EXTEND | | | | | | | | | | | | | |
| IDLE | YES | NO | NO | NO | NO | NO | NO | NO | NO | NO | NO | NO | NO |
| BEGIN | YES | YES | NO | NO | NO | YES | NO | YES | NO | NO | YES | YES | NO |
| EXTENDING | YES | NO | YES | NO | NO | YES | YES | YES | NO | NO | YES | YES | NO |
| EXTENDED | YES | NO | YES | NO | NO | YES | YES | NO | YES | NO | YES | NO | NO |
| RETRACTING | YES | NO | NO | NO | NO | YES | YES | NO | YES | NO | YES | NO | YES |
| RETRACTED | YES | NO | NO | NO | NO | NO | NO | NO | NO | NO | NO | NO | NO |

-continued

SELF-CONTAINED COMPACTOR CIRCUIT

| DEVICE | ON-STOP PB | START PB | RETR. PB | RELAY R1 | R2 | R3 | R4 | T1 | T2 | CR | MOT. START AUX | EXT. SOLEN | RETR. SOLEN |
|---|---|---|---|---|---|---|---|---|---|---|---|---|---|
| LOAD 100% DURING EXTEND | | | | | | | | | | | | | |
| IDLE | YES | NO | NO | NO | NO | NO | NO | NO | NO | NO | No | NO | NO |
| BEGIN | YES | YES | NO | NO | NO | NO | NO | YES | NO | NO | YES | YES | NO |
| EXTENDING | YES | NO | NO | YES | YES | YES | NO | YES | NO | YES | YES | YES | NO |
| EXTEND/TIMED | YES | NO | NO | YES | YES | YES | NO | NO | YES | YES | YES | NO | NO |
| RETRACTING | YES | NO | NO | YES | YES | YES | NO | NO | YES | NO | YES | NO | YES |
| RETRACT/TIMED | YES | NO | NO | YES | YES | NO | NO | NO | NO | NO | NO | NO | NO |

A stop button 269 similar to that of the previously described circuits is provided to disconnect power from the circuit 200 and to act as emergency stop, for example. While stop button 269 may be also utilized as an on-off device, a main power on-off switch is generally provided for the circuit 200, but is not illustrated in FIG. 7. A push start button 267 is the main control for starting a cycle of operation of the circuit 200. Capability of manual operation to retract the cylinder and the ram is provided by a push retract button 265.

In addition to T1 relay 201 and T2 relay 202, circuit 200 includes R1 relay 210, R2 relay 220, R3 relay 230, R4 relay 242 and R5 relay 255. A current relay 250 with delay, also designated CR, forms a similar function in the circuit 200 of FIG. 7 as in the circuit 100 of FIG. 5. 120V AC power is provided to circuit 200 at terminals 273 and 275, the latter of which is connected to a ground 271. A fuse 279 or another appropriate protective device is connected at power input terminal 273. Motor 245 similar to motor 145 of FIG. 5 is controlled by a motor starter 240 having auxiliary contacts 241 labelled MS AUX. A 100% full light 253 is provided similar to light 153 in circuit 100 of FIG. 5. The direction of motion of the ram driven by cylinder 613 is controlled by an extend solenoid 237 and a retract solenoid 235.

With reference to the Self-Container Compactor Circuit table, it will be noted that in the initial idle condition of the compactor before pressing the start push button, the motor starter is not activated nor are any of the relays R1, R2, R3, R4, T1, T2, or CR. R5 relay 255 is never activated in normal operation and is not shown in the Table. Accordingly, in the initial idle condition, the following contacts are closed: T2 contacts 204, R1 contacts 211, R2 contacts 221, T1 contacts 205, and R4 contacts 243; the following contacts are open: MS AUX contacts 241, R4 contacts 246, T1 contacts 203, R5 contacts 257, T1 contacts 203, CR contacts 251, R2 contacts 222, R4 contacts 244, T2 contacts 206, T1 contacts 207 and 247, and R3 contacts 231. Referring again to the Self-Contained Compactor Circuit table, it will be noted that pressing the start button 267 begins operation of the compactor and causes actuation of relay R3 and time delay relay T1. It will be noted that activation of T2 relay 201 does not immediately cause the T1 contacts to operate because of the 20 to 25 second time delay which the T1 relay provides for operation of contacts (the time delay does not occur in the operation of T1 or T2 contacts when those relays are deactivated.) Pressing start button 267 also activates motor starter 240 (and motor 245) causing MS AUX contacts 241 to close. Contacts 241 maintain the circuit connection across contacts of start button 267 after the release of the start button. Consequently, in the extending portion of the cycle all relays remain as before except that the start button is no longer depressed.

Shortly after the time when the cylinder has had time to drive the ram to its fully extended position, the T1 contacts of time delay T1 relay 201 operate; contacts 203 close activating relay T2 (but not operating its time delay contacts). Time delay T1 contacts 205 open and extend solenoid 237 is deactivated. Immediately thereafter the circuit enters the retraction part of the cycle. T1 contacts 207 being closed activate the retract solenoid and the circuit remains in that status during retraction until the time delay T2 relay 202 causes all T2 contacts to be operated. Referring back to FIG. 6, the acceptability of having the extend solenoid activated beyond the time when the hydraulic cylinder is fully extended (or having the retract solenoid activated beyond the time when the hydraulic cylinder is fully retracted) relies upon the limit valve feature of the hydraulic cylinder which bypasses hydraulic fluid and pressure to avoid strain or damage on the system at either the fully extended or the fully retracted position.

Some time after the cylinder drives the ram to the fully retracted position, the contacts of time delay T2 relay 202 are operated activating R1 relay 210, opening the contacts 211 of R1 relay, deactivating motor starter 240, deactivating R3 relay 230 and restoring all relays to the original idle condition.

The foregoing explanation assumes that there has been no operation of retract button 265 and that current relay 250 has not sensed 100% current indicating fullness of the compactor container. The operating sequence when the retract push button is pressed during the extend portion of the cycle is shown in the table, and, since it does not form a part of the present invention, will not be explained in great detail. Briefly stated, the pressing of retract button 265 before the end of the extending portion of the cycle causes R4 relay 242 to be locked on by contacts 246 and contacts 243 and 247 operate producing a transition to the retract function activating solenoid 235 (in the same fashion as if the contacts of time delay relay 201 had operated). Time delay T2 relay 202 is activated starting its delay period after which the sequence is similar to that of the NO LOAD condition.

The sequence of operations when a load of 100% is encountered during the extend portion of the cycle is shown in the Self-Contained Compactor Circuit table. When a 100% load is encountered during extend, current relay 250 is activated and the contacts thereof operate following a 1 to 6 second time delay. In the circuit 200 a 100% full light 253 is illuminated and is locked on by relay R2 with contacts 222 and 221. The contacts 221 open deactivating motor starter 240 and motor 245, also deactivating the relay 230, extend solenoid 237 and retract solenoid 235. Circuit 200 is restored to the idle condition except that R2 relay 220 is activated to lock on 100% full light 253.

It should be noted that the circuit 200 includes an error light 259 and circuit elements for the control thereof not shown in the Self-Container Compactor Circuit table. If through some malfunction the compactor ram should jam or there should be an excessively high current that operates current relay 250 during the retract portion of the cycle, error light 259 will be illuminated to show the operator that there is a problem. The 100% full light will also be illuminated. Error light 259 is locked on by R5 relay 255 having contacts 257. R5 relay 255 is prevented from operating on the extend portion of the cycle by T1 contacts 203 or other appropriate circuit connection. As will be seen from FIG. 7 and this explanation, error light 259 is an optional feature which can be omitted without any effect on the normal operation of circuit 200.

Summarizing the description of FIG. 7 and of the Self-Contained Compactor Circuit 200 it will be noted that, in the Self-Contained Compactor in which the hydraulic ram and the container function as a unit separable from the electric and hydraulic power pack, it is desirable to avoid reliance on limit switches. This eliminates critical electrical connections from the hydraulic cylinder and ram compaction apparatus to the power pack and controls. Circuit 200 of FIG. 7 virtually eliminates control by limit switches and instead employs timing devices coordinated with the travel time for the hydraulic cylinder driven ram. This is made practical by the use of limit valves built into the hydraulic cylinder and, effectively, places the hydraulic cylinder driven ram in an idle condition when it reaches an extreme position of extension or retraction. Clearly the circuit 200 of FIG. 7 could be utilized in other situations where one preferred to utilize timing devices rather than limit switches for controlling the extend and retract portions of the operating cycle of compaction apparatus. The current relay with delay has generally similar advantages in this form of apparatus (without limit switches) as previously described for circuits of FIG. 2 and FIG. 5; such description may be considered to be incorporated here.

Numerous variations and equivalent element substitutions for the apparatus and the circuits disclosed are possible and will be apparent to those skilled in the art. These include, but are not limited to, substitution of solid state relays for electro-mechanical relays (or vice-versa), substitution of other types of motors, timing devices, and limit switches or proximity switches.

Although the present invention has been described with particular relation to the embodiments illustrated and specified and modifications thereof, it is apparent that other variations and modifications of the apparatus apart from those shown or suggested may be made by those skilled in the art within the spirit and scope of this invention.

What is claimed is:

1. Compaction apparatus for waste management or recycling comprising:

an enclosure for receiving waste materials;

a ram driven by a reversible hydraulic cylinder associated with said enclosure;

a retract-extend control for said hydraulic cylinder responsive to an electric signal;

an electric motor driven pump connected to power said hydraulic cylinder;

an electrical position sensor comprising a limit switch for generating a signal indicating presence of said ram at a retracted position;

an inductive over current sensor switch arranged to sense current drawn by said motor as a measure of a resistive force on said ram; said sensor switch having a time delay of at least 0.2 seconds and not more than 10 seconds from sustained over-current condition to switch actuation;

said apparatus having at least one mode of operation in which there are electrical connections from said current sensor switch and said limit switch to said retract-extend control to cause said ram to discontinue extend or retract operation;

whereby said ram is caused to rest at a retracted position until said retract-extend control is reactivated to cause forward motion of said ram, and ram motion is stopped or reversed only by encountering resistance to forward movement which persists for a predetermined time thereby avoiding false stopping of the ram by temporary incidents.

2. Apparatus as recited in claim 1 wherein said enclosure is arranged for said ram to compact waste therein, said enclosure having an access opening for removing compacted material therefrom and a closure for said access opening.

3. Apparatus as recited in claim 2 wherein said electrical position sensor is a mechanical limit switch.

4. Apparatus as recited in claim 1 wherein said limit switch is a mechanical limit switch.

5. Apparatus as recited in claim 4 further including a position sensor for generating a signal indicating presence of said ram at an extended position.

6. Apparatus as recited in claim 4 further including a mechanical limit switch indicating presence of said ram at an extended position.

7. Apparatus as recited in claim 6 wherein said sensor switch has a time delay adjustment control.

8. Waste compaction apparatus for waste management or recycling comprising:

a ram driven by a reversible hydraulic cylinder;

an enclosure for which said ram operates to compact waste therein;

an access opening in said enclosure for receiving material to be compacted;

a solenoid valve responsive to an electric signal;

an electric motor and a pump driven by said motor connected to power said hydraulic cylinder;

an electrical position sensor comprising a limit switch for generating a signal indicating presence of said ram at a retracted position;

an inductive over-current sensor switch arranged to sense current drawn by said motor as a measure of a resistive force on said ram; said switch having a time delay of at least 0.2 seconds and not more than 10 seconds from sustained over-current condition to switch actuation, a current threshold adjustment control, and a visual indicator of over-current;

a retract-extend control for said hydraulic cylinder comprising a first electrical relay having contacts which operate in response to a signal from said current sensor switch and a second electrical relay having contacts which operate in response to a signal at least in part dependent on the condition of said limit switch;

said apparatus having at least one mode of operation in which there are electrical connections from said current sensor switch and said limit switch to said retract-extend control to cause said ram to discontinue extend operation;

whereby said ram is caused to rest at a retracted position until said retract-extend control is reactivated to cause forward motion of said ram and ram motion is stopped or reversed only by encountering resistance to forward movement which persists for a predetermined time thereby avoiding false stopping of the ram by temporary incidents.

9. Apparatus as recited in claim 8 wherein said enclosure has an opening for material to be compacted communicating with a removable trash container.

10. Apparatus as recited in claim 9 further including a further position sensor for generating a signal indicating presence of said ram at an extended position.

11. Apparatus as recited in claim 10 wherein said further position sensor is a mechanical limit switch.

12. Apparatus as recited in claim 8 further including a position sensor for generating a signal indicating presence of said ram at an extended position.

13. Apparatus as recited in claim 8 further including a mechanical limit switch indicating presence of said ram at an extended position.

14. Apparatus as recited in claim 8 wherein said sensor switch has a time delay adjustment control.

15. Apparatus as recited in claim 8 further including electrical connections from said sensor switch to said retract-extend control to cause said ram to shift from extend to retract position.

16. Compaction apparatus for waste management or recycling comprising:

an enclosure for receiving waste material;

a ram driven by a reversible hydraulic cylinder associated with said enclosure;

an electric motor driven pump connected to power said hydraulic cylinder;

an electrical position sensor for generating a signal indicating presence of said ram at a retracted position;

an inductive over-current sensor switch arranged to sense current drawn by said motor as a measure of a resistive force on said ram;

said sensor switch having a time delay of at least 0.2 seconds and not more than 10 seconds from sustained over-current condition to switch actuation;

a retract-extend control for said hydraulic cylinder responsive to electrical signals and including a first electrical relay having contacts which operate in response to a signal from said current sensor switch and a second electrical relay having contacts which operate in response to a signal derived from said electrical position sensor;

said apparatus having at least one mode of operation in which there are electrical connections from said current sensor switch and said electrical position sensor to said retract-extend control to cause said ram to discontinue extend or retract operation;

whereby said ram is caused to rest at a retracted position until said retract-extend control is reactivated to cause forward motion of said ram and ram motion is stopped or reversed only by encountering resistance to forward movement which persists for a predetermined time thereby avoiding false stopping of the ram by temporary incidents.

17. Apparatus as recited in claim 13 wherein said sensor switch has a sensitivity adjustment control.

18. Apparatus as recited in claim 13 wherein said electrical position sensor is a mechanical limit switch.

* * * * *